10/15/85 XR 4,547,174

United States Patent [19]

Lee et al.

[11] Patent Number: 4,547,174

[45] Date of Patent: Oct. 15, 1985

[54] INERTIA MOTORS FOR TOY VEHICLES

[75] Inventors: James S. W. Lee, Long Island, N.Y.; Kwong-Wai Chow, Kowloon, Hong Kong; Alfred T. Y. Lau; Ming-Ngar Chow, both of Hong Kong, Hong Kong

[73] Assignee: Zima Products, Ltd., Hong Kong, Hong Kong

[21] Appl. No.: 591,463

[22] Filed: Mar. 20, 1984

[51] Int. Cl.[4] ..... A63H 29/24

[52] U.S. Cl. ..... 446/463; 74/354

[58] Field of Search ..... 446/463, 462, 457, 461, 446/464; 74/354, 810, 572

[56] References Cited

U.S. PATENT DOCUMENTS

| | | | |
|---|---|---|---|
| 1,063,959 | 6/1913 | Clark | 446/461 |
| 4,059,918 | 11/1977 | Matsushiro | 446/463 X |
| 4,116,084 | 9/1978 | Masuda | 446/463 X |
| 4,387,604 | 6/1983 | Maher | 446/462 X |
| 4,422,263 | 12/1983 | Masubuchi | 446/462 |
| 4,475,305 | 10/1984 | Kawakami et al. | 446/463 |

*Primary Examiner*—Mickey Yu
*Attorney, Agent, or Firm*—Martin L. Stern

[57] ABSTRACT

An inertia motor especially—but not exclusively—for a toy vehicle. A rear wheel axle extends through the housing and has a drive gear mounted thereon to turn unitarily therewith. A flywheel is rotatably mounted on the housing for spinning to store or to payout energy. First and second gear trains extend between the drive gear and flywheel. A movable control lever carries first and second movable gears, one of the movable gears being an idler mounted on and movable with a shaft which passes through a pair of oppositely disposed arcuate slots, the other movable gears being mounted on a shaft journaled in the lever arm. The arcuate slots are located so that the idler gear meshes with one of the gear trains when the lever arm is in one of its two positions. The teeth on the meshing gears dynamically pull the shaft to one end of the arcuate slots and into the one gear train when the drive gear is driving and pushing the shaft to the other end of the arcuate slots to eject the idler from the one gear train when the flywheel is driving. The journals for the shaft of the other movable gear are located on the lever arm so that the other movable gear meshes with the other of the gear trains when the lever arm is in the other of its two positions. The arcuate slots are part of molded plastic parts which may be made with the precision of the mold, thereby improving performance and reducing wear from poor tolerances used heretofore.

7 Claims, 11 Drawing Figures

INERTIA MOTORS FOR TOY VEHICLES

This invention relates to inertia motors especially—although not necessarily exclusively—for toy vehicles and, more particularly, to motors which may be reved-up to store energy in a spinning flywheel, which energy may, in turn, be released on command to propel and drive the toy vehicle.

Examples of toy motors using energy stored in a spinning flywheel are found in U.S. Pat. Nos. 4,130,963 and 4,363,185. In general, wheeled toys using this type of motor are rolled along a surface to store energy by reving-up a flywheel. The energy is transmitted via a first gear train extending between the wheels of the toy and the flywheel. The ratio of this first gear train is such that there is a quick accumulation of a relatively large amount of energy in the flywheel. This quick accumulation is possible because the person (even a very young child) who is rolling the toy during rev-up is very strong relative to the weight of the toy, the inertia in the flywheel, the amount of stored energy, etc.

Once the flywheel is spinning, the gear train is shifted. Energy is transferred from the spinning flywheel through a second gear train to the wheels of the toy, which propels it. The ratio of the second gear train is such that the energy in the spinning flywheel is paid out relatively slowly to propel the toy over longer distances. This slow payout of energy is possible because the toy is fairly light and quite small relative to the amount of energy stored in the flywheel.

This description of toy vehicles is given by way of example. The motor may be used for any purpose if it can be reved-up to store energy and then that energy can be released to perform a useful function.

In a motor of the described type, the gear train may be shifted in any of several different ways. One way is to provide an idler gear mounted on a shaft that is free to float from one end to an opposite end of an arcuate slot. When the wheels are rolled during rev-up, the energy originates at the end of the first gear train which begins with those wheels. Then, the direction of rotation of the idler urges its shaft to move to one end of the arcuate slot, which shifts the idler into the first gear train. When the wheels stop driving the gear train, the energy source becomes the flywheel and the gear train begins to transfer energy toward the toy wheels. The direction of the idler gear turning ejects it from the first gear train, which urges the idler shaft to move to the opposite end of the arcuate slot. The idler is thus declutched from the first gear train so that the spinning flywheel may continue to coast without the mechanical impedence which would result from a transfer of energy through a gear train to the wheels of the toy. When another gear shifting occurs, energy is paid out from the spinning flywheel, through a second gear train to the wheels. Thus, there are three states which must be considered: (a) rev-up, (b) declutch, and (c) drive.

One problem is that an unrestrained shaft turning in an arcuate slot is rotating in a poor journal, which allows the idler to dance and, therefore, to unduly wear both the shaft and the idler gear teeth.

Superimposed upon this wear problem is the need to make toys at the lowest possible cost. An engineering principle which works very well when parts are machined with precision may be unacceptable when parts are simply cast, stamped out, or are otherwise made by low cost methods. Also, some parts which can be made on precision tooling cannot be made by low cost tooling. Thus, the ability to make the toy at a very low cost often becomes a very important consideration.

If the gears in the toy are physically moved by a lever to relocate the shiftable gear, as is done in an automobile, the physical acts of holding a toy by one hand while moving the lever by another hand, tends to deflect the motion of the car and to squander the energy stored in the spinning flywheel. Thus, the self-propelled toy may follow an erratic path with a quick loss of energy.

Accordingly, an object of the invention is to provide new and improved inertial motors. Here, an object is to provide a smoother, more reliable, and better operating inertial motor. In particular, an object is to provide balanced forces on opposite ends of the shaft of floating idler wheels to reduce wear and to give a better performance.

A further object of the invention is to provide an inertial toy motor which resists damage from a person who pushes it with an excessive amount of force, during a rev-up.

Another object of the invention is to provide a gear train which makes a maximum use of molded plastic gears and a minimum use of machined metal gears.

Yet, another object is to provide a gear train wherein the gear teeth are less prone to damage. Especially, an object is to avoid an intermeshing of gears made of dissimilar materials (such as plastic gears meshing with bronze gears). Here, an object is to provide such gear protection, especially when rotational forces acting on gear teeth exceed predetermined limits. In this connection, an object is to minimize the need for relatively expensive journal bushings.

An inertia motor for a toy vehicle having an axle carrying supporting wheels for the toy with a drive gear mounted on and turning unitarily with the axle, a rotable flywheel for storing or paying out energy, first and second gear trains extending between said drive gear and said flywheel, control means mounted for movement between two positions and carrying first and second movable gears, a pair of oppositely aligned spaced parallel arcuate slots formed in said control means, the shaft of a first of said movable gears passing through said pair of arcuate slots, the other of said movable gears being mounted on a shaft journaled in said control means, said arcuate slots being located so that said idler gear dynamically meshes with one of said gear trains when said control means is in one of its two positions, the teeth on the idler gear meshing to pull said shaft to one end of said arcuate slots so that said idler gear dynamically moves into said one gear train when said drive gear is driving said one gear train and to push said shaft to the other end of said arcuate slots to eject said idler gear from said one gear train when said flywheel is driving said one gear train, and said journals for the shaft of the other movable gear being located at a position on said movable means so that said other movable gear meshes with the other of said gear trains when said movable means is in the other of its two positions.

A preferred embodiment of the invention is shown in the attached drawings, wherein.

Figure 8:
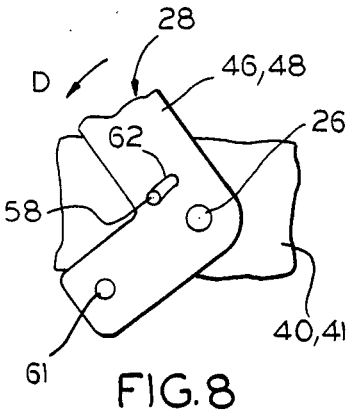
Figure 9:
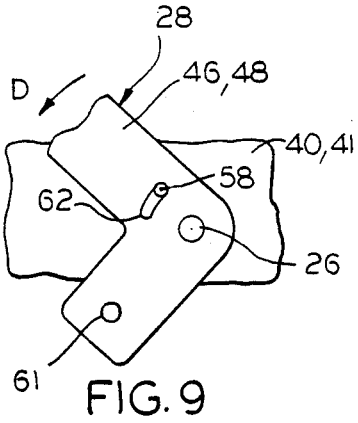
Figure 10:
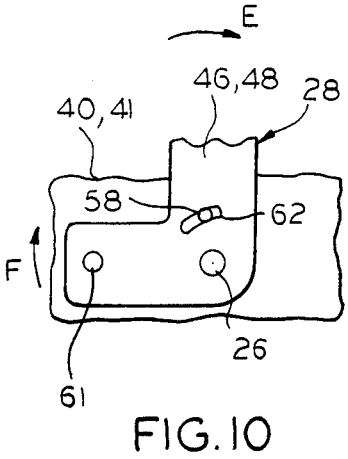

FIG. 8 schematically shows the idler gear shaft in one end of the arcuate slots during rev-up;

FIG. 9 schematically shows the idler gear shaft in the opposite end of the slot to declutch the idler from the gear train; and FIG. 10 schematically shows the operated lever arm, with the idler gear shaft captured in the declutched end of the arcuate slots, while a second movable gear engages a second gear train to deliver energy to the wheels of a toy.

Figure 1:
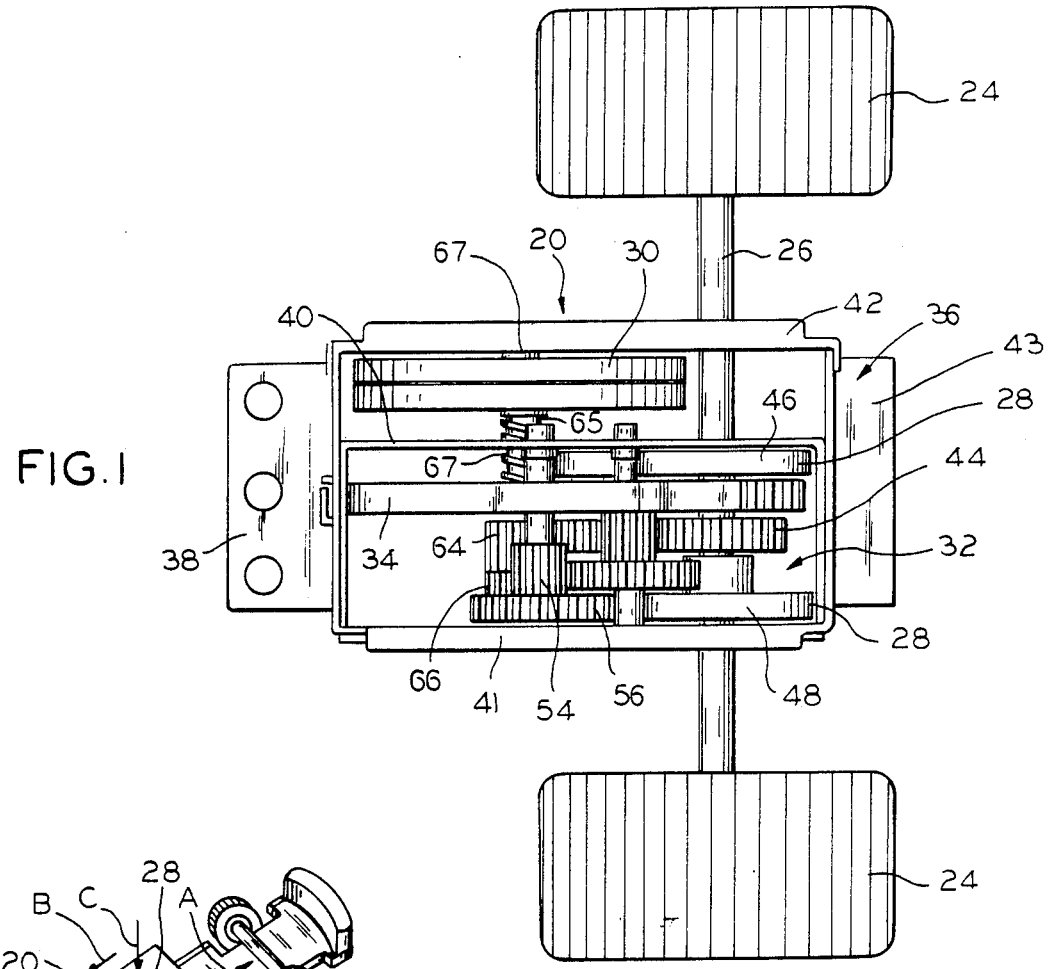
FIG. 1 is a top plan view of the inventive gear box with the housing removed.
Figure 1A:
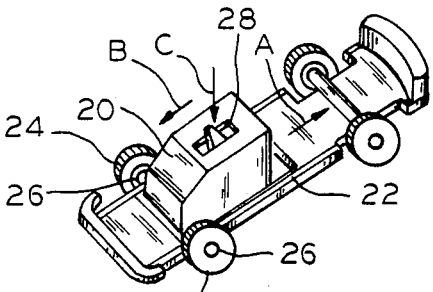
FIG. 1A shows a chassis of an exemplary toy having the inventive gear box mounted thereon.

FIG. 1*a* shows the inventive inertial motor 20 mounted on a chassis 22 which is supported by four wheels, two of which are numbered 24. The motor 20 is connected to axle 26 which turns with the rear or driven wheels. When the chassis 22 is rolled in direction A, energy is imparted through a first gear train to rev-up a flywheel in motor 20. A lever arm 28 has a cam shaped top so that when a force C (such as a push button) pushes downwardly, the lever moves back in direction B to shift gears inside motor 20. The energy of the spinning flywheel is transmitted through a second gear train to axle 26 and the rear wheels 24. The vehicle is propelled in direction A responsive to the release of the energy stored in the spinning flywheel.

Any suitable body may be mounted on the chassis 22 to make it look like a toy auto, truck, tank, motorcycle, or the like.

The interior of the motor 20 is seen in FIGS. 1 and 3–5, as including a flywheel 30, a gear train 32, a reset control leaf spring 34, and housing 36. The housing 36 is made of sheet metal panels joined together in any suitable manner and including front housing panel 38, middle housing panel 40, side panels 41, 42, and rear housing panel 43. These housing parts are assembled in a conventional manner to form a first compartment containing the flywheel 30 and a second compartment containing gear train 32 and control lever 28.

Figure 2:
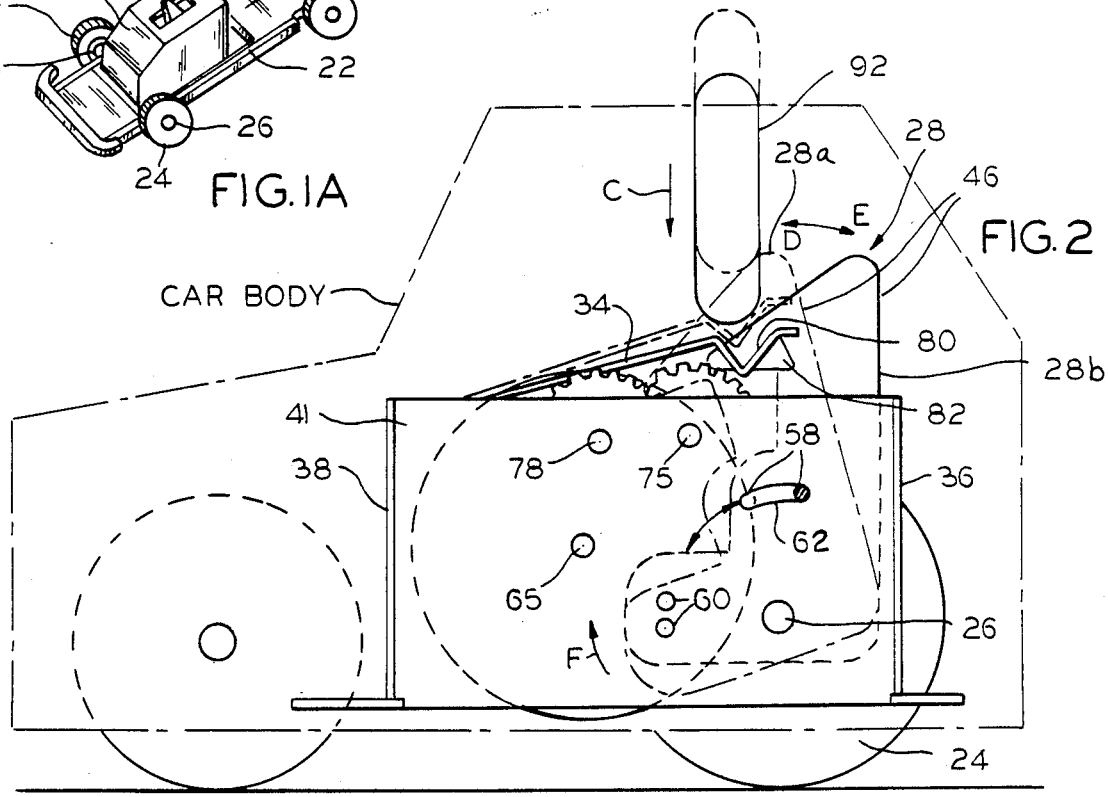
FIG. 2 is a side elevation of the inventive gear box, showing the housing, with an internal gear shift lever shown in two positions and a flywheel shown by dashed lines.

The two rear or driven wheels 24 and the gear 44 are unitarily mounted on and turn with the rear axle 26. The control lever arm 28 (FIG. 7) includes rear bracket piece 46 and a front bracket piece 48 which are rotatably mounted on the wheel shaft or axle 26. Thus, the lever arm 28 rotates freely on and turns about axle 26. FIG. 2 uses dot-dashed lines to show lever 28 in forward position 28*a* and solid or dashed lines to show lever 28 in a rear position 28*b*, with rotation about rear axle 26. The lever arm is automatically moved to its forward position (direction D) when an idler gear meshes into a first gear train. The lever arm is pushed to its rear position (direction E) by a push button acting in direction C.

Two movable gears 50, 52, 54 and 56 are mounted on shafts 58 and 60, respectively, which are, in turn, mounted to extend between the front and rear bracket pieces 46 and 48 (FIG. 7) of lever arm 28. Pinion 50 and gear 52 are integral, as are pinion 54 and gear 56. Shaft 58 passes through a pair of arcuate slots 62, and shaft 60 passes through a pair of journals or holes 61. Axle 26 passes through holes 63. Therefore, when lever 28 is moved back and forth, the two movable gears 50–56 also move. Plastic gear 52 and its integral bronze pinion 50 together form an idler gear mounted on shaft 58, which is free to move back and forth along an opposed and aligned pair of arcuate slots 62 in bracket pieces 46 and 48.

Bronze gears 64, 66 (FIG. 1) and fly wheel 30 are mounted on shaft 65, with a compression spring 67 between the flywheel and the gear 64. This design prevents damage to the gear teeth of bronze gears 64, 66 and to supporting bushings for the flywheel shaft. Plastic step gear 72 (FIG. 3) is a gear with an integral plastic pinion 74 mounted on shaft 75. Plastic step gear 76 and its integral plastic pinion 77 are mounted on shaft 78.

Only gears 44, 50, 54, 64, and 66 are bronze; all other gears are plastic. Upon inspection of the drawings, it will be found that bronze gears mesh with each other and that plastic gears mesh with each other, except that plastic gear 76 meshes with bronze gear 66 and plastic gear 56 meshes with bronze gear 64 because their shafts do not move and, therefore, wear problems are not severe. The plastic gear train transfers power through the bronze gear train because plastic gear 52 has an integral bronze pinion 50, the two of which rotate as a unit. The same is true with plastic gear 56 and its bronze pinion 54.

The general principles of the invention are schematically shown in FIGS. 6–10. The opposite ends of shaft 58 of the floating idler gears 50, 52, pass through arcuate slots 62 in side bracket pieces 46, 48. An advantage of this construction is that bracket pieces may be molded from plastic and, therefore, the arcuate slots may be made and aligned very accurately. This mounting is schematically shown in the exploded view of FIG. 6, the perspective view of the lever arm 28 (FIG. 7), and in stop motion views of FIGS. 8–10.

Figure 6:
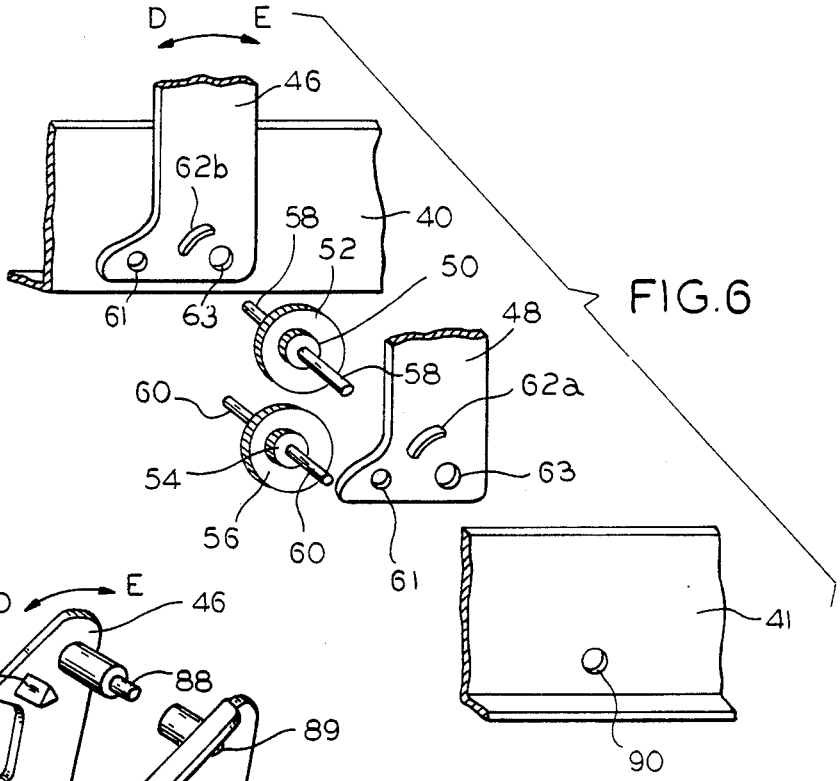
FIG. 6 is an exploded view showing fragments of two side brackets of the lever arm, two sides of the motor housing, a floating idler gear and a non-floating movable gear mounted on a shaft which travels in the arcuate slots.
Figure 7:
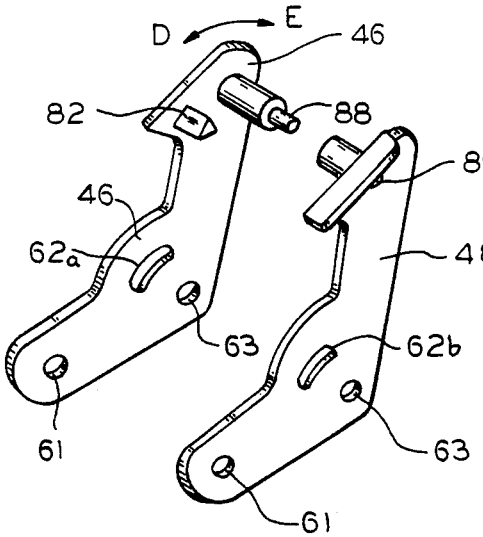
FIG. 7 is a perspective view of a control lever having one front bracket piece and one rear bracket piece before being assembled togehter to form a control lever unit.

Inside and adjacent the motor housing side walls 41, 40 are the spaced parallel front and rear brackets 46, 48 of the control lever 28 which includes opposed and aligned arcuate slots 62*a*, 62*b*. As shown in FIG. 7, lever 28 has these two brackets which are two separate plastic pieces joined by plastic peg 88 fitting into a hole 89, which are integral parts of these two brackets. Therefore, the two brackets 46, 48 form lever arm 28 and move as a unit. Lever arm 28 rotates about the rear wheel axle 26 which passes through holes 63, 63 in the side brackets 46, 48, and through holes 90 in the two side panels 40, 41 (FIG. 6). The lever arm 28 may rock back and forth in directions D and E.

The shaft 58 of the floating idler gear 50, 52 passes through the arcuate slots 62*a*, 62*b*, in brackets 48, 46. Another movable gear and pinion 56, 54 (FIGS. 3–5) are mounted on a shaft 60 which passes through opposing bracket holes 61, 61. Hence, it is seen that there are two moving pinions and gears 50, 52, 54, 56 which are mounted on and moved with lever arm 28.

When the lever 28 is moved in direction D (FIG. 8) and while the toy is being pushed to rev-up the flywheel 30, the teeth on the rear axle drive gear 44 engage the teeth of pinion 50. The resulting forces pull the lever arm 28 in direction D and move shaft 58 of floating idler 52 to the left-hand end of the aligned arcuate slots 62. There is enough engagement between teeth on the gears 44, 50 to initiate this movement of lever 28 even when the lever arm 28 is preset at the end of its travel in direction E. However, there is not enough engagement to cause an interference when the flywheel is driving rear axle drive gear 44. The gear engagement between gears 44, 50 connects the toy's driven wheels 24, 24 to the flywheel 30 via a first power delivering gear train 44, 50, 52, 74, 72, 77, 76, 66, in order to transfer energy from the drive wheels through a high ratio power train to the flywheel 30.

When the lever 28 is in the left-hand position (direction D) and the toy is not being pushed, the energy from the spinning flywheel 30 is reflected back through this first gear train to push against the teeth of gear 52 and eject it outwardly and away from a meshing engagement with the pinion of gear 72. Pinion 50 moves out of engagement with the rear axle drive gear 44. Shaft 58 (FIG. 9) moves to the right-hand end of the aligned arcuate slots 62, (FIG. 9) to declutch the first gear train. The flywheel may now spin freely with substantially no loss of energy, except to friction.

When the lever 28 moves back in direction E (FIG. 10), the gear 52 moves far away from pinion 74 to reduce shaft wear and to positively prevent an engagement between pinion 50, the first gear train, and rear axle drive gear 44. The idler 52 thus remains disengaged from the first gear train until the energy from the spinning flywheels is dissipated or until the vehicle is pushed again to add more energy to the flywheel during rev-up.

A second moving gear 54, 56 is mounted on a shaft 60 passing through holes 61, 61 (FIG. 6). As lever 28 moves in direction E, gear 56 rocks forward and upward (direction F) into engagement with gear 64 and a second gear train (44, 54, 56, 64). As the teeth of gear 56 engages the teeth of gear 64, lever 28 is moved a little further back in direction E to further disengage pinion 74 and gear 52. After the energy of the flywheel is dissipated, and there is no dynamic pull between the teeth of gears 56, 64, the lever arm 28 pulls forward easily by the pushing force generated by gear 56 and pinion 64 to the position of FIG. 8 during the next rev-up.

Figure 3:
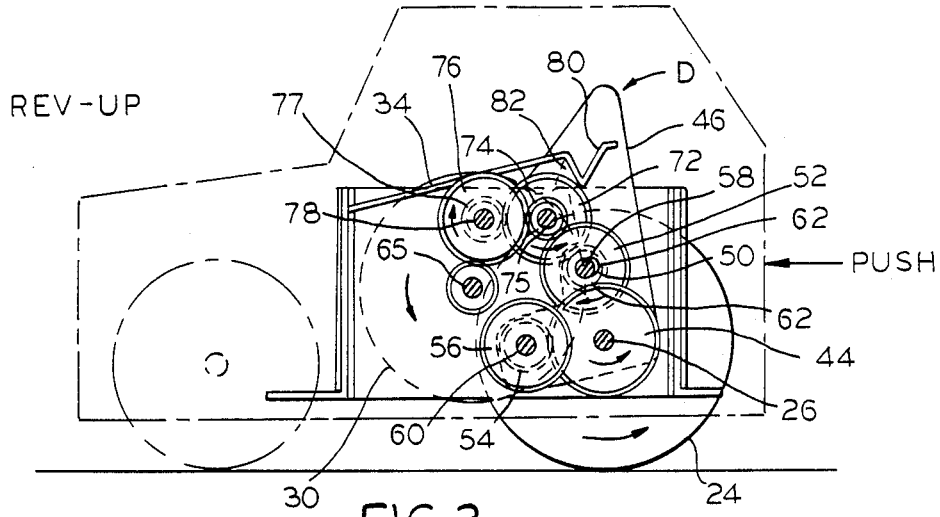
FIG. 3 is substantially the same side elevation that is shown in FIG. 2, except that the side of the housing is removed, and the idler gear is shown in the left-hand end of an arcuate slot in the gear shift lever, which is the rev-up position.
Figure 4:
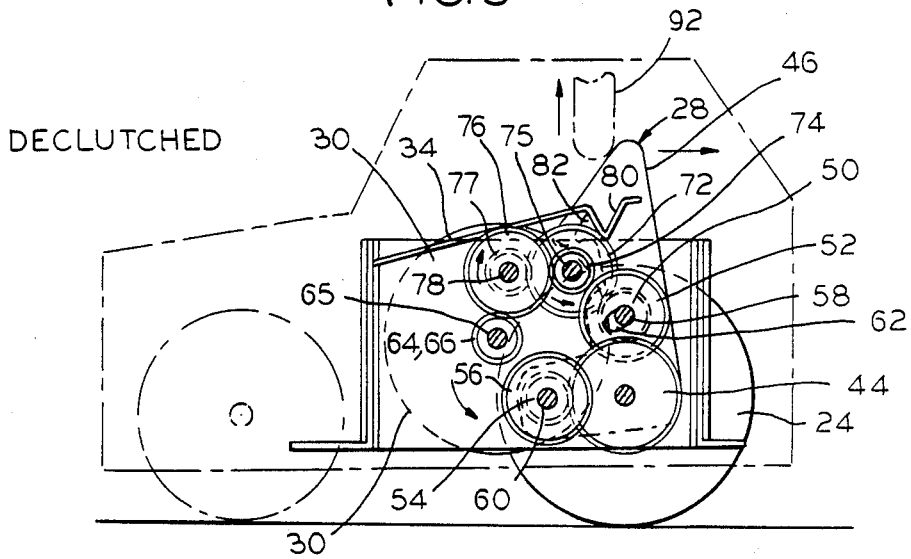
FIG. 4 is the same view that is shown in FIG. 3, except that the idler gear has moved to the right-hand end of the arcuate slot, which is the declutched position.
Figure 5:
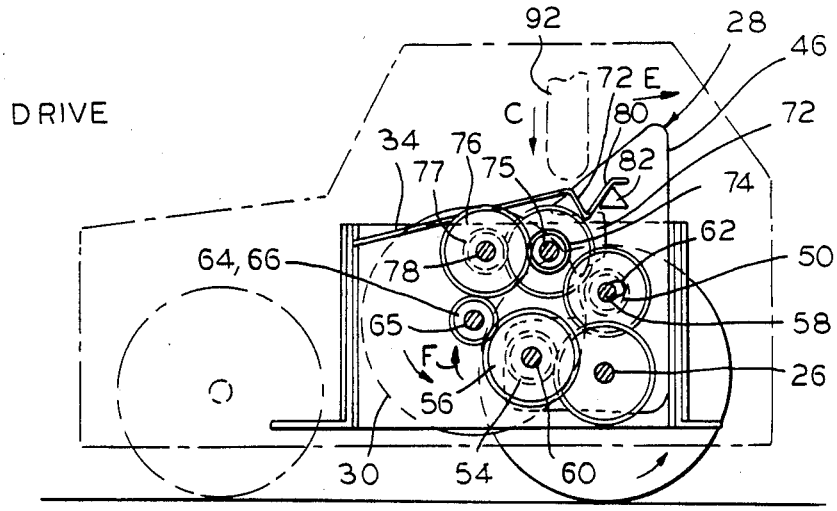
FIG. 5 is the same view that is shown in FIG. 4, except that the lever arm has moved to the right, which is the drive or energy payout position.

The simplified schematic showing of FIGS. 6–10 may be compared with the detailed showing in FIGS. 3–5. It is seen that when the lever 28 is in its left-most position (FIG. 3) and during actual rev-up, shaft 58 is at the left end of slot 62, the pinion 50 of idler gear 52 engages the drive gear 44. The gear 56 does not engage gear 64 while the lever 28 remains in its left-most position. While arm 28 is in the left position (FIG. 4), not during the actual rev-up, and while flywheel 30 is spinning, shaft 58 is in the right end of slot 62. Idler 52 is ejected from its engagement with the pinion 74 of gear 72. This declutches the first gear train, so that the flywheel 30 continues to spin and does not lose any energy except to friction.

In FIG. 5, a push button 92 is pushed to exert a downward force C which acts upon a cam surface at the top of lever arm 28, to move the arm rightwardly (direction E). The moving gear 56 moves upwardly (direction F) and engages the gear 64. Hence, in FIG. 5, the gear box has been shifted from a first to a second gear train.

In operation, the toy is pushed forward to rev-up the flywheel 30 and to store energy applied via the first gear train. There is a high gear ratio in the first gear train to store large amounts of energy in the flywheel 30. After the energy is so stored, the toy will not go, until a push button 92 is depressed. Then, the moving gear 56 moves to shift into a second gear train, with lower gear ratio 56, the energy stored in the spinning flywheel 30 drives through gear 44 to move the toy forward.

When the lever arm 28 moves in direction D (FIG. 3), a detent keeper 82 integrally formed on the rear bracket 46 of arm 28 moves under a "vee" end 80 of a reset spring 34. This spring end 80 snaps over detent keeper 82 to positively hold the lever arm 28 in the forward position during rev-up and during declutching (FIG. 4). After the flywheel (FIG. 4) is reved-up and while it is spinning at a high velocity, the toy may remain stationary with the idler gear shaft 58 in the right-end of aligned slots 62*a*, 62*b*, (FIGS. 4, 6, 8). When the push button 92 (FIG. 5) is pressed to move lever arm 28 back in direction E, the leaf spring 34 flexes and the detent keeper 82 moves from the position shown in FIG. 4, under the "vee" end 80, to the position shown in FIG. 5. The "vee" end 80 now positively holds the lever 28 in the rear, power delivery position.

Those who are skilled in the art will readily perceive how to modify the system. Therefore, the appended claims are to be construed to cover all equivalent structures which fall within the true scope and spirit of the invention.

The claimed invention is:

1. An inertia motor comprising a housing, an axle supported by said housing and having a drive gear mounted thereon to turn unitarily therewith, a flyweel rotatably mounted on said housing for spinning to store or to payout energy, first and second gear trains supported by said housing and extending between said drive gear and said flywheel, lever means pivoted to move between two positions, a pair of oppositely aligned spaced parallel arcuate slots formed in said lever, said lever means carrying first and second movable gears, one of said movable gears being an idler mounted on and movable with a shaft, the shaft of said idler gear passing through said pair of oppositely aligned arcuate slots, the other of said movable gears being mounted on a shaft journaled in said lever means, said arcuate slots being located so that said idler gear meshes with one of said gear trains when said lever means is in one of its two positions, the teeth on the gears meshing to pull said shaft to one end of said arcuate slots so that said idler moves into said one gear train when said drive gear is driving said one gear train and to push said shaft to the other end of said arcuate slots to eject said idler from said one gear train when said flywheel is driving said one gear train and said journals for the shaft of the other movable gear being located on said lever means so that said other movable gear meshes with the other of said gear trains when said lever means is in the other of its two positions.

2. The inertia motor of claim 1, wherein said lever means has first and second bracket parts with said shafts extending therebetween and said movable gears mounted on said shafts are positioned between said parts, each of said bracket parts having one of said arcuate slots and one of said journals formed therein to receive said shafts, whereby the ends of said shafts are held with balanced forces.

3. The inertia motor of claim 1, and keeper means formed on said lever means, spring means mounted on said housing and cooperating with said keeper means for holding said lever in each of said two positions.

4. The inertia motor of claim 1, and means responsive to said gears being driven by said axle for dynamically pulling said lever to said one position.

5. The inertia motor of claim 1, and cam means formed on said lever means to force it to move from said one position to said other position responsive to a push upon said cam means.

6. An inertia motor for a toy vehicle having an axle carrying supporting wheels for the toy with a drive gear mounted on and turning unitarily with the axle, a rotable flywheel for storing or paying out energy, first and second gear trains extending between said drive gear and said flywheel, control means mounted for movement between two positions and carrying first and second movable gears, a pair of oppositely aligned spaced parallel arcuate slots formed in said control means, a shaft of a first of said movable gears passing through said pair of arcuate slots, the other of said movable gears being mounted on a shaft journaled in said control means, said arcuate slots being located so that an idler gear dynamically meshes with one of said gear trains when said control means is in one of its two positions, the teeth on the idler gear meshing to pull said shaft to one end of said arcuate slots so that said idler gear dynamically moves into said one gear train when said drive gear is driving said one gear train and to push said shaft to the other end of said arcuate slots to eject said idler gear from said one gear train when said flywheel is driving said one gear train, and said journals for the shaft of the other movable gear being located at a position on said movable control means so that said other movable gear meshes with the other of said gear trains when said movable control means is in the other of its two positions.

7. The inertial motor of claim 6 wherein said control means is molded from plastic whereby the shape and alignment of said arcuate slots are made with the close tolerance precision of the mold which makes said control means.

* * * * *